US005570101A

United States Patent [19]

Martin

[11] Patent Number: 5,570,101

[45] **Date of Patent: *Oct. 29, 1996**

[54] BROADCASTING SET COMPRISING A WIRE-DIPOLE ROTARY ANTENNA AND ROTATING JOINT DESIGNED FOR THIS SET

[75] Inventor: Jean-Marc Martin, St Leu La Foret, France

[73] Assignee: Thomson-CSF, Paris, France

[ * ] Notice: The term of this patent shall not extend beyond the expiration date of Pat. No. 5,515,063.

[21] Appl. No.: 322,997

[22] Filed: Oct. 14, 1994

[30] Foreign Application Priority Data

Oct. 15, 1993 [FR] France ..... 93 12287

[51] Int. Cl.[6] ..... H01Q 21/12

[52] U.S. Cl. ..... 343/814; 343/815

[58] Field of Search ..... 343/814, 815, 343/763, 766; 333/24 R, 24 C

[56] References Cited

U.S. PATENT DOCUMENTS

| | | | |
|---|---|---|---|
| 3,914,715 | 10/1975 | Hubing et al. | 333/24 R |
| 4,001,832 | 1/1977 | Chesneau et al. . | |
| 4,001,833 | 1/1977 | Chesneau et al. . | |
| 4,543,549 | 9/1985 | Meltzer et al. | 333/24 C X |
| 4,780,725 | 10/1988 | Ursenbach | 343/815 |
| 5,012,170 | 4/1991 | Atlas | 343/766 X |
| 5,146,233 | 9/1992 | Ursenbach | 343/815 |
| 5,162,807 | 11/1992 | Ursenbach et al. . | |
| 5,175,526 | 12/1992 | Martin . | |
| 5,270,725 | 12/1993 | Ursenbach et al. . | |

FOREIGN PATENT DOCUMENTS

| | | |
|---|---|---|
| 0524045 | 1/1993 | European Pat. Off. . |
| 2371785 | 6/1978 | France . |
| 2556508 | 6/1985 | France . |

OTHER PUBLICATIONS

Funkschau, No. 6, 1965, pp. 141–142, Karl Tetzner, "Drehstandantennen Fur Kurzwellen–Rund Funksender".

Telecommunications and Radio Engineering, vol. 32/33, No. 1, Jan. 1978, pp. 1–11, G.Z. Eisenberg, et al., "Antenna–Feeder Devices Antennas for Radio Broadcasting, Radio Communications and Television".

Telecommunications and Radio Engineering, vol. 33/34, No. 9, Sep. 1979, pp. 1–5, S.P. Belousov, et al., "Antennas–Feeder Devices Antenna Arrays with a Wide Scanning Sector".

*Primary Examiner*—Donald T. Hajec
*Assistant Examiner*—Tho Phan
*Attorney, Agent, or Firm*—Oblon, Spivak, McClelland, Maier & Neustadt, P.C.

[57] ABSTRACT

The disclosure relates to broadcasting by means of rotary antennas using wire dipoles. Two distinct feeder channels respectively leave two transmitters, go through the joint that separates the fixed support from the mobile part of the rotary antenna, then go out horizontally, on either side of the mast, taking support on the bearing structure of the rotary antenna to then rise vertically to the supply points of the dipoles of two distinct vertical groupings of the dipoles: it is thus possible to carry out two simultaneous transmissions from one and the same rotary antenna. Application to broadcasting in decameter waves.

4 Claims, 7 Drawing Sheets

BROADCASTING SET COMPRISING A WIRE-DIPOLE ROTARY ANTENNA AND ROTATING JOINT DESIGNED FOR THIS SET

BACKGROUND OF THE INVENTION

The present invention relates to broadcasting sets comprising a wire-dipole rotary antenna, designed to work with decameter waves.

Sets of this kind exist. Their rotary antenna has a fixed base surmounted by a vertical mast which, in association with horizontal girders, most usually supports two parallel vertical curtains of wire dipoles, separated by one or two vertical curtains of horizontal wires that play the role of wave reflectors. Certain antennas have only one curtain of dipoles associated with one curtain of wires. Each curtain of dipoles, with its reflector, constitutes an antenna proper. In certain applications, a portion of the dipoles of this antenna, according to choice, may or may not be powered, this being achieved by means of switching assemblies. Hereinafter, the complete set with the curtains of dipoles and the reflector curtain or curtains shall be called a rotary antenna whenever it is necessary to avoid confusion with the two antennas proper, Which are also called antenna faces or dipole curtains or high-frequency antennas and low-frequency antennas. The latter two terms express the fact that, of the two curtains of dipoles of a rotary antenna, one is designed to work in high frequencies, for example in the 13/15/17/21/26 MHz bands located between 13,600 and 26,100 MHz while the other is designed to work in the low frequencies, for example in the 6/7/9/11 MHz bands located between 5,950 and 12,050 MHz.

The dipoles of each of the two curtains are generally arranged in rows and columns, symmetrically with respect to the projection of the axis of the mast in the plane of the curtain. As for the power supply to the dipoles, it is provided by means of a feeder that sets up links between a transmission source on the ground and either of the two curtains of wire dipoles. For this purpose, a feeder cable goes out from the supply source, goes through the rotary crown between the fixed base and the mast, gets sub-divided into two cables that go out horizontally along two horizontal girders fixedly joined to the mast and gets sub-divided again to go out vertically and supply or feed the different dipoles. It must be noted that there are known ways of using switches in this feeder line to allow or bar the supply of certain dipoles of the antenna in order to use only one curtain when there are two of them, or to use only all or a part of the dipoles of a curtain in order to cause variations in the elevation angle of the curtain considered.

The rotary antennas presently in operation use only one transmission source at a time. This is especially so in high-powered broadcasting. Now, given the cost of a broadcasting antenna whose height goes up to several tens of meters, it would be useful to be able to use these antennas together with two transmission sources transmitting simultaneously. Indeed, broadcasting stations are now increasingly transmitting in dual frequencies in one and the same direction, i.e., one and the same program is sent out in one and the same direction on two different frequencies, for example, 6 and 7 MHz. For this purpose, there is a known way of using two rotary antennas, each with one transmitter. Sending one and the same program on two frequencies is therefore a costly approach since it requires two rotary antennas and since one rotary antenna is very costly.

SUMMARY OF THE INVENTION

The present invention is aimed at overcoming this drawback by proposing a broadcasting set having only one wire-dipole rotary antenna that is capable, however, of working in at least the following two configurations:

- two transmissions on, respectively, two half-faces of one face of the rotary antenna, on two different frequencies,
- one transmission on a complete face of the rotary antenna on one given frequency, and, furthermore, in the case of a rotary antenna with two curtains of dipoles, in the following configuration:
- one transmission on one face of the rotary antenna on a first frequency and one transmission on the other face on a second frequency that is different from the first frequency; it must be noted that when the two curtains of dipoles are separated by two distinct reflector curtains, one only for the high frequencies and the other only for the low frequencies, the transmission frequencies on the two faces may be the same provided that at least one frequency band is common to the high frequencies and to the low frequencies.

This is obtained especially by giving one vertical part of the rotary antenna a feeder line that is independent of the feeder line designed for the other vertical part.

According to the present invention, there is provided a broadcasting set formed by transmission means and a rotary antenna, the transmission means comprising two transmitters and supply means for the antenna, the antenna comprising a support with a fixed base, a vertical mast, a bi-coaxial rotating joint positioned between the base and the mast, pairs of horizontal girders positioned in one and the same vertical plane and fixed to the mast at different levels, the lowest pair constituting a platform on either side of the mast, m, with m as a positive integer smaller than 3, vertical reflector curtains and n, with n as an integer and $m \leqq n < 3$, parallel vertical curtains of wire dipoles each associated with one of the reflector curtains, the supply means having two distinct channels whose paths respectively leave the two transmitters, go into the joint, rise within the mast up to the platform where they separate to respectively follow the two beams of the platform to which the channels are respectively fixed, then rise up vertically to the dipoles to respectively supply the dipoles of two distinct vertical portions of the n curtains of dipoles, the distinct channels each comprising a symmetrizer in the part of the path where they follow the platform.

According to the present invention, there is further provided a rotating joint designed for a broadcasting set fitted out with a wire-dipole rotary antenna and comprising a metal pack formed by two half-packs in contact along a circular plane zone, one of the half-packs being fixed, the other being capable of rotating while keeping the contact along the circular zone, two coaxial ports per half-pack, these ports each having an external conductor in electrical contact with its half-pack and an internal conductor that penetrates its half-pack, at least two of the four internal conductors of the four ports of the pack being extended into the pack by sliding contacts, parallel to the plane zone, to set up two electrical links beginning respectively on the two ports of one of the half-packs and respectively reaching the two ports of the other one of the half-packs.

BRIEF DESCRIPTION OF THE DRAWINGS

The present invention will be understood more clearly and other features shall appear from the following description and from the appended drawings of which.

MORE DETAILED DESCRIPTION

In the different figures, the corresponding elements are designated by the same references.

Figure 3:
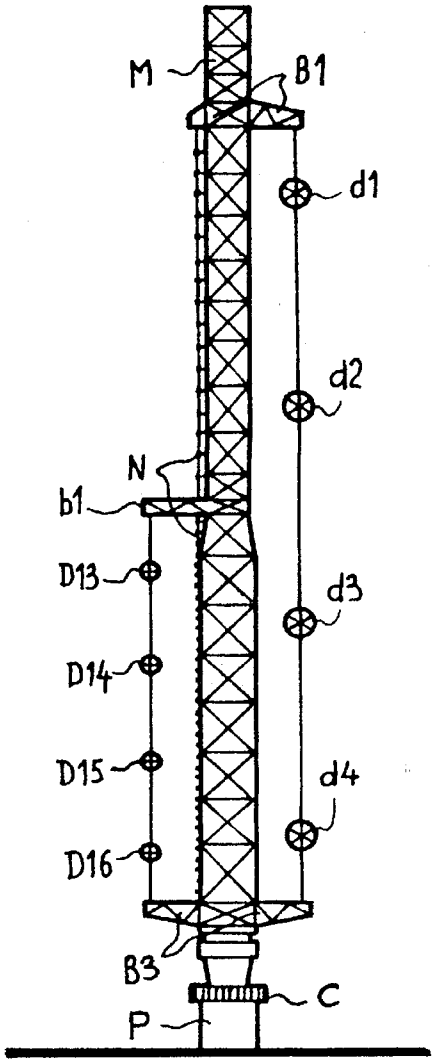
FIGS. 1 to 3 show a broadcasting set for the implementation of the invention.
Figure 1:
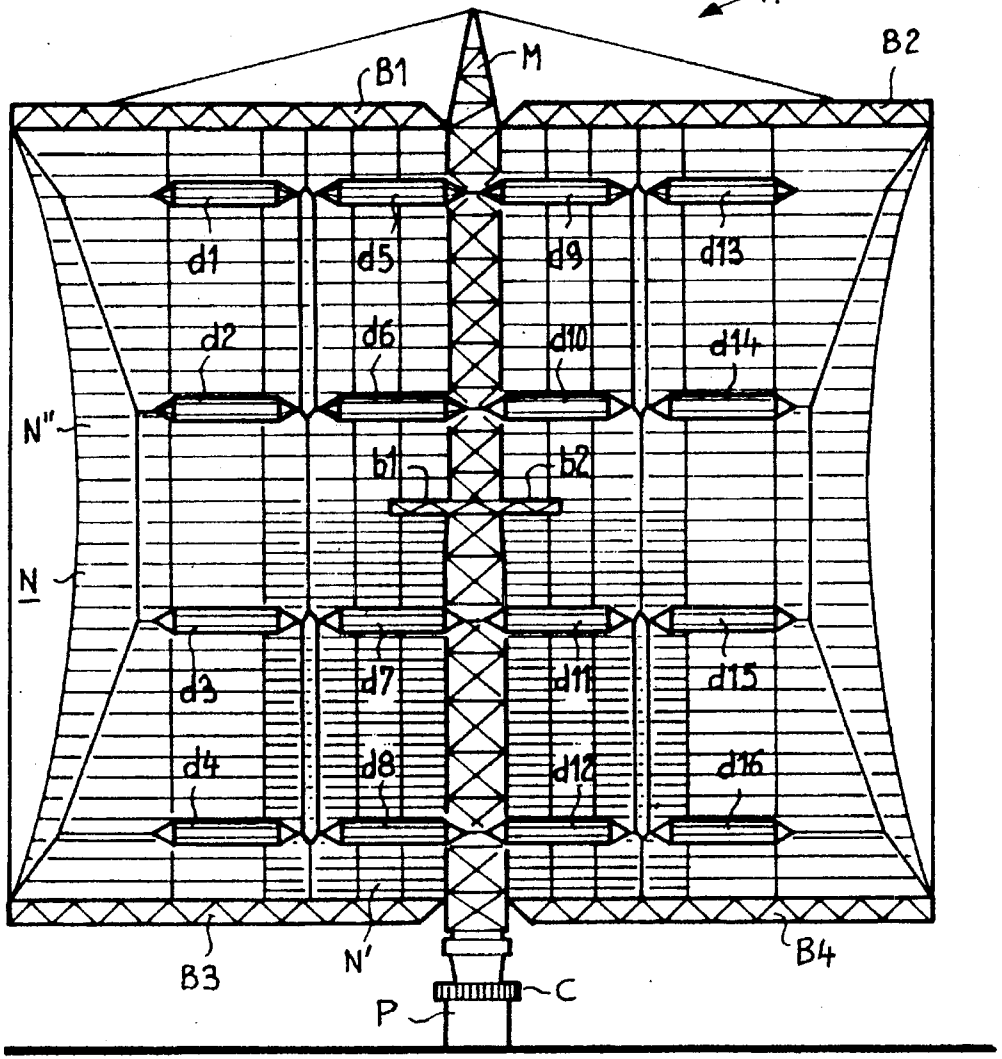
Figure 2:
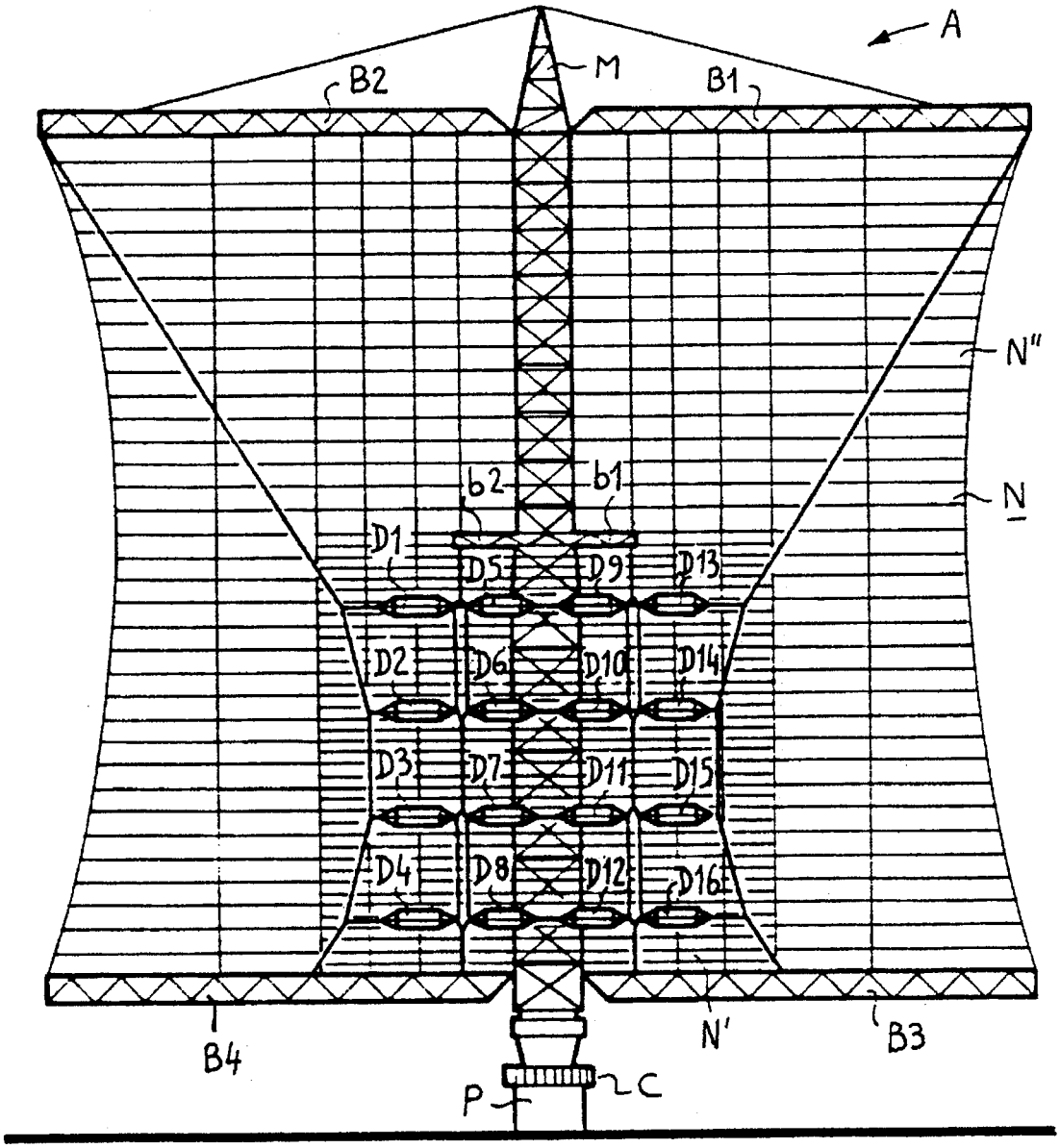

FIGS. 1, 3 and 3 show a double rotary antenna for decameter waves, having a height of 82 meters and a span of 76 meters. This broadcasting set has a support and two antennas proper. The support has a fixed mast foot P surmounted by a rotating ring C which is itself surmounted by a vertical mast M to which there are fixed three pairs of horizontal arms B1–B2, B3–B4 and b1–b2. The mast and the six arms are used to support the following, in three parallel planes, by means of cables:

- a first vertical curtain formed by horizontal semi-dipoles d1 to d16 associated by pairs such as d1–d5; this curtain of dipoles is seen in a front view in FIG. 1,
- a vertical sheet N of horizontal wires,
- a second vertical curtain formed by horizontal semi-dipoles D1 to D16 associated by pairs such as D1–D5; this curtain of dipoles is seen in a front view in FIG. 2

This double antenna A is an HR 4/4/0.5 type antenna for the face visible in FIG. 1, the semi-dipoles d1 to d16 constituting, with the sheet N, a low-frequency antenna designed to work in the 6-7-9-11 MHz frequency band, namely in the band of frequencies ranging from 5.950 to 12.050 MHz.

The double antenna A is an HR 4/4/1 type antenna for the face visible in FIG. 2, the semi-dipoles D1 to D16 constituting, with the sheet N, a high-frequency antenna designed to work in the 11-13-15-17-21-26 MHz frequency bands, namely in the band of frequencies ranging from 11.650 to 21.100 MHz. In this high-frequency antenna, as can be seen in FIGS. 2 and 3, the curtain of dipoles, formed by semi-dipoles D1 to D16, is half as high and half as wide as the sheet N and is supported partly by the auxiliary arms b1, b2.

The sheet N has two parts N' and N". As the double antenna A has a surface area substantially smaller than the surface area of the sheet N, this particular feature is put to use so that the wires of this sheet are given a small spacing only in the part N' facing the high-frequency antenna. Since the part N" of the sheet N has a role to play only in the low-frequency antenna, the spacing of its wires is half that of the wires of the part N'.

The pair of lower arms B3–B4 constitutes a platform whence, in a standard way, feeders rise vertically to supply the dipoles. In the example described, they are cables forming vertical beams that go through the middle of the dipoles d4–d8, d12–d16, D4–D8 and D12–D16, and then rise towards the upper dipoles. The platform B3–B4 is wide and forms a platform for the antenna assembly and maintenance teams.

FIG. 3 is the diagram of the supply of the dipoles of the rotary antenna of FIGS. 1 to 2 as provided within the framework of the invention. For purposes of easier representation and comprehension, the proportions have not been maintained in this figure.

The supply according to FIG. 3 is provided by means of two transmitters E1, E2 positioned in a room near the foot P of the mast referred to in the description of FIGS. 1 to 3. This supply system comprises a fixed part that goes from the transmitters to a bi-coaxial rotating joint J and a rotating part that goes from the joint J to the dipoles. The joint J is positioned in the center of the ring C shown in FIGS. 1 to 3, and it has the same vertical rotation axis as this ring.

The transmitters E1, E2 are each connected by a coaxial cable G1, G2 to two coaxial inputs of the rotating joint J. Into the coaxial cables G1, G2 there are inserted measuring probes connected to a phase comparator N. This phase comparator, when put into operation, is used to control the transmitters E1, E2 so that they transmit in phase.

The joint J is described further below by means of FIGS. 5 and 6. It has two coaxial outputs respectively connected by two coaxial cables G3, G4 followed by two symmetrizers Sd, Sg to the common points 0f two band-changing switches Qd, Qg. The band-changing switches have two positions, one position in which they establish a link with the common point of a high-frequency switch, Khd, Khg, and one position in which they establish a link with the common point of a low-frequency switch Kbd, Kbg. The low-frequency and high-frequency switches have impedance transformers. The switch Kbg controls the supply of the dipoles d1–d5, d2–d6, d3–d7, d4–d8; the switch Kbd controls the supply of the dipoles d9–d13, d10–d14, d11–15, d12–d16. The switch Khg controls the supply of the dipoles D9–D13, D10–D14, D11–D14, D11–D15, D12–D16; the switch Khd controls the supply of the dipoles D1–D5, D2–D6, D3–D7, D4–D8. Details on the structure of these switches will be given by means of FIGS. 9 and 10.

Figure 5:
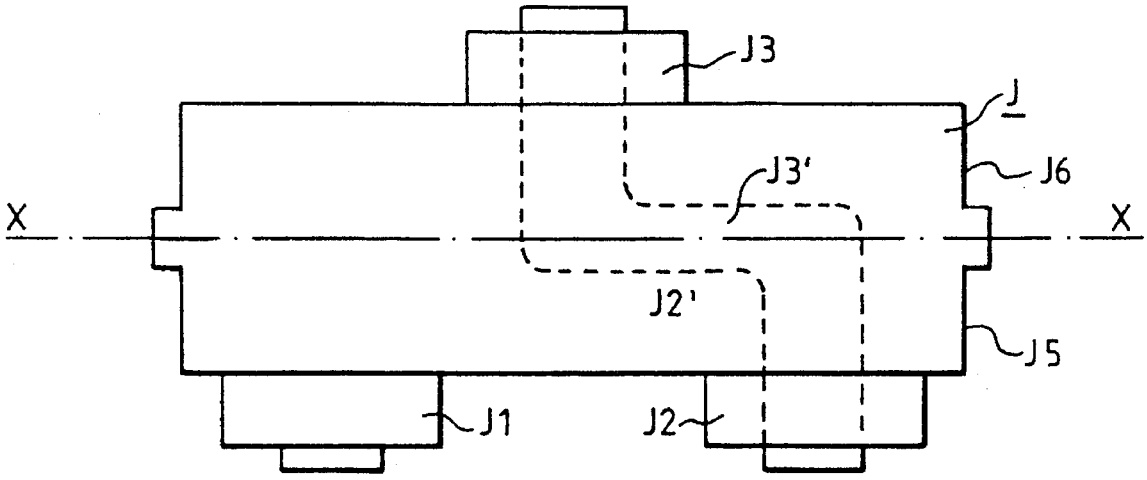
Figure 6:
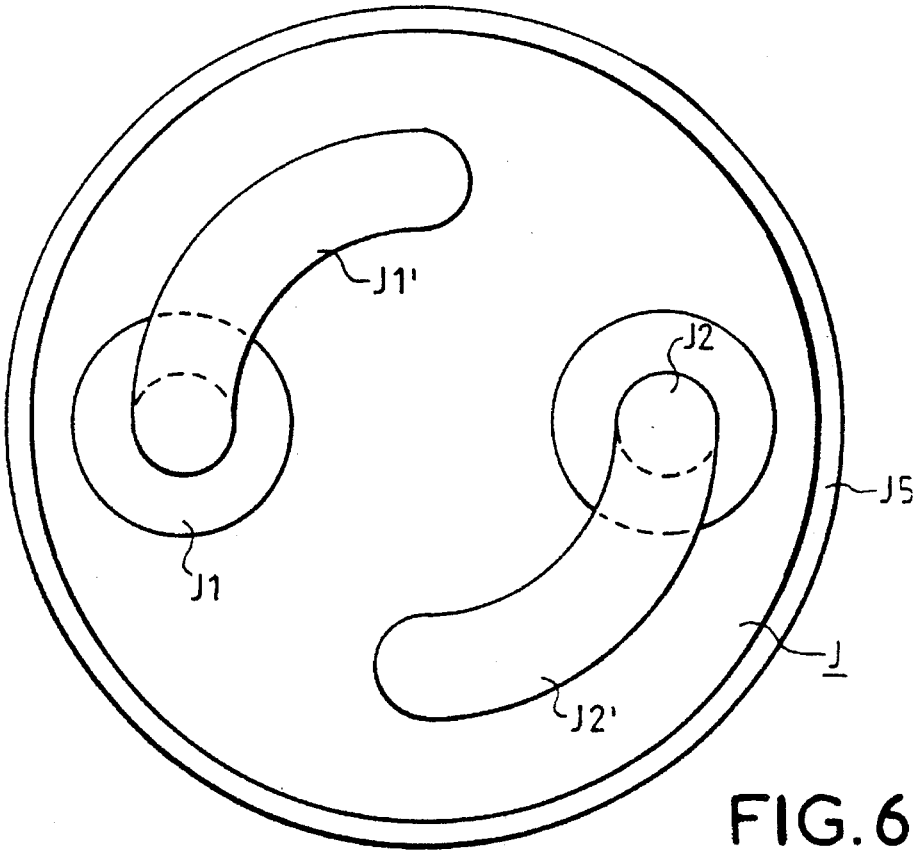

FIGS. 5 and 6 show views of the joint J of FIG. 3. The joint is formed by two identical half-joints, each of them constituting a half-pack. These half-joints are located on either side of a line XX in FIG. 5 and are in sliding contact along a circular zone located in a plane that is perpendicular, along XX, to the plane of FIG. 5. That one of the half-packs which is located below the line XX is fixedly joined to the foot of the mast shown in FIGS. 1 to 3 while that one of the half-packs which is located above the line XX is fixedly joined to the rotating part of the rotary antenna. FIG. 6 shows the half-joint fixedly joined to the foot of the mast, namely the fixed half-joint. It is seen from the top in this figure. It has a metal half-pack J5 with two coaxial connectors J1, J2. The external conductor of the coaxial connectors is soldered to the half-pack and the internal conductor is extended first of all vertically and then horizontally by a crescent-shaped plate J1' in the half-pack. The plate is designed to provide for a sliding contact in the plane which already contains the sliding contact zone between the two half-packs. In the same way, the upper half-joint has a metal half-pack J6 and two coaxial connectors J3, J4 with a plate J3', J4', but only the connector J3 is seen in FIG. 5. The connector J4 is concealed by the connector J3 since, in this figure, the half-packs are rotated by 90° with respect to each other. The position shown in FIG. 5 is the one wherein the plates of the output connectors J3, J4 of the joint precisely overlap the plates J1, J2 of the input connectors. To make it easier to understand the drawing, only the parts of the connectors J2, J3 contained in the pack J have been shown as if seen by transparency.

Figure 7:
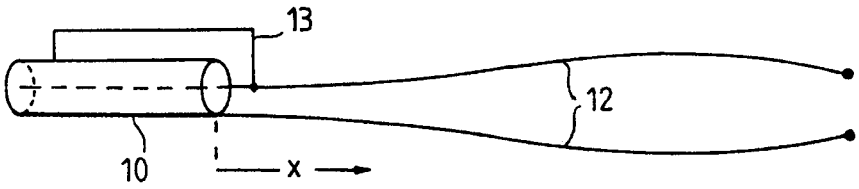

FIG. 7 shows a known type of symmetrizer as described especially in the French patent 2.556 508 filed on 13 Dec., 1983 and as used to form the symmetrizers Sd, Sg according to FIG. 3. This is a symmetrizer to couple a coaxial line to a bifilar line. This symmetrizer comprises, in series, a section of coaxial cable 10 and a symmetrical bifilar line 12 with a conductor 13 in parallel on the section of coaxial cable. In this symmetrizer, the symmetrical line 12, which has a length L, is designed to have, between its ends, an impedance variation Z=f(x) with x between zero and the length of the line 12 which, in plane rectilinear coordinates, has the shape of an S.

Figure 4:
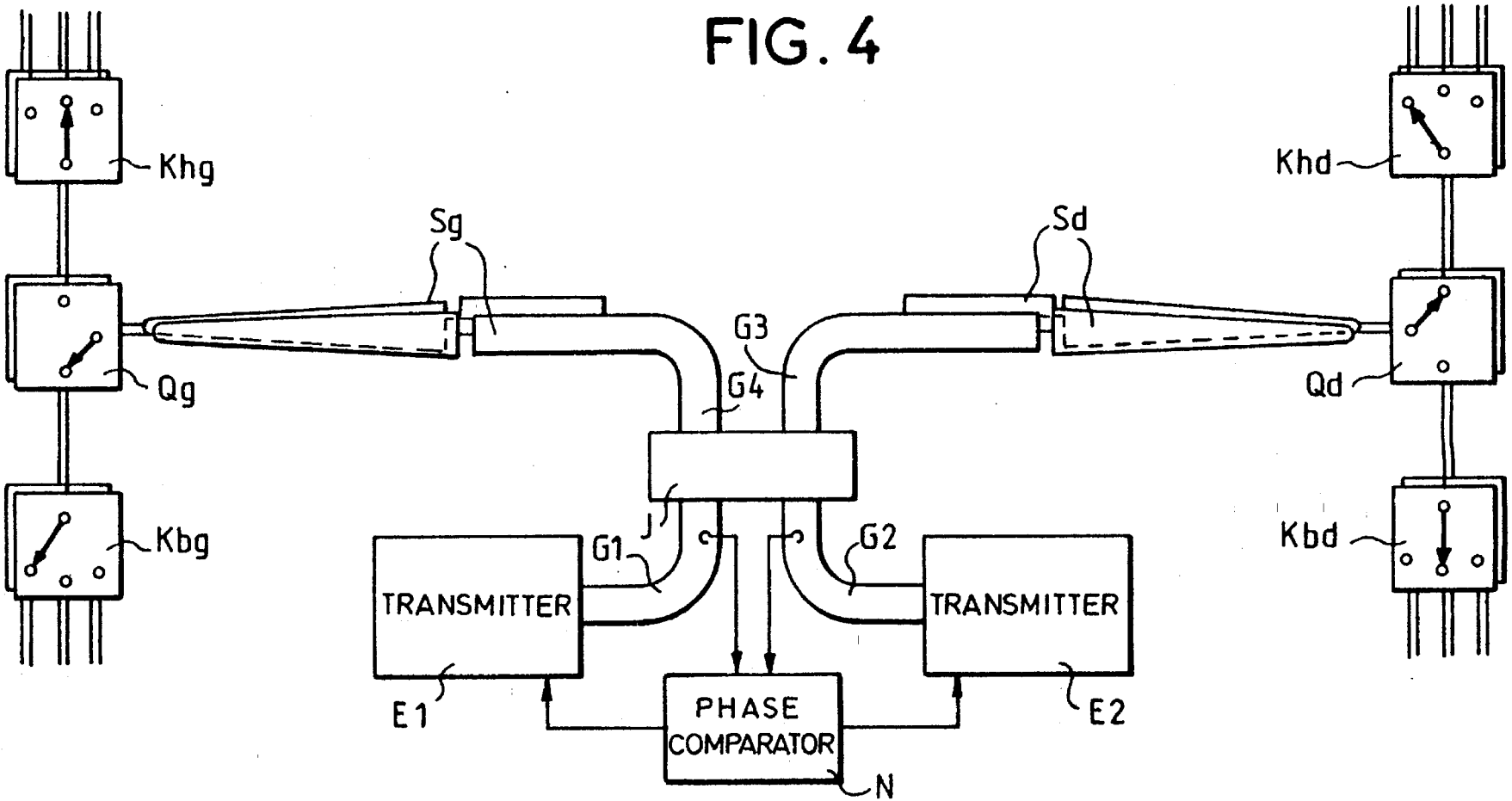
FIG. 4 shows means to implement the invention in the set according to FIGS. 1 to 3, FIGS. 5 to 10 show detailed views to specify or complete FIG. 4.

In FIG. 4, the symmetrizers Sd, Sg are shown with the two elements of the symmetrical bifilar line seen from the top but slightly offset while in FIG. 7 the two elements of the symmetrical bifilar line are shown in a side view. By contrast, in these two figures, the conductors such as 13 in FIG. 7 have been shown each time in the plane of the figure so as to avoid their being identified with the output of the internal conductor of the coaxial cable section.

Figure 8:
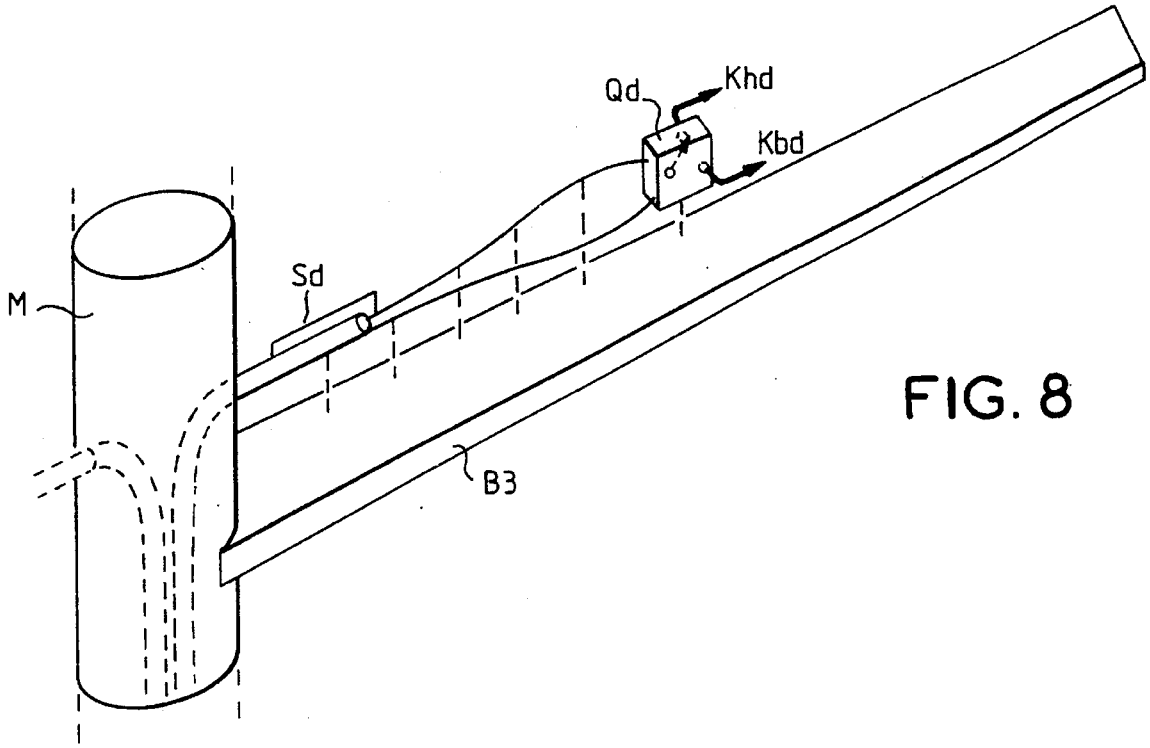

FIG. 8 shows a schematic view in perspective, here again without the proportions being respected, of the mast M at the level of the girder B3 of the platform, the symmetrizer Sd which is held to the girder B3 by insulating spacers represented by dashes and the two-position switch, Qd, also fixed to the beam B3. The two bifilar outputs of the switch Qd, which are connected respectively to the switches Khd and Kbd, have been shown in bold lines but these switches, which themselves are also fixed to the girder B3, have not been shown. They shall be described by means of FIGS. 9 and 10.

The switches Khd, Kbd, Khg, Kbg are all made on the same model and are differentiated from one another only by the impedance transformers that they contain, these impedance transformers being different, in the high-frequency switches, from the impedance transformers in the low-frequency switches. Thus only the switch Kbd, which controls the supply 0 of the dipoles d9–d13, d10–d14, d11–d15, d12–d16 and is shown in FIGS. 9 and 10, will be described.

Figure 9:
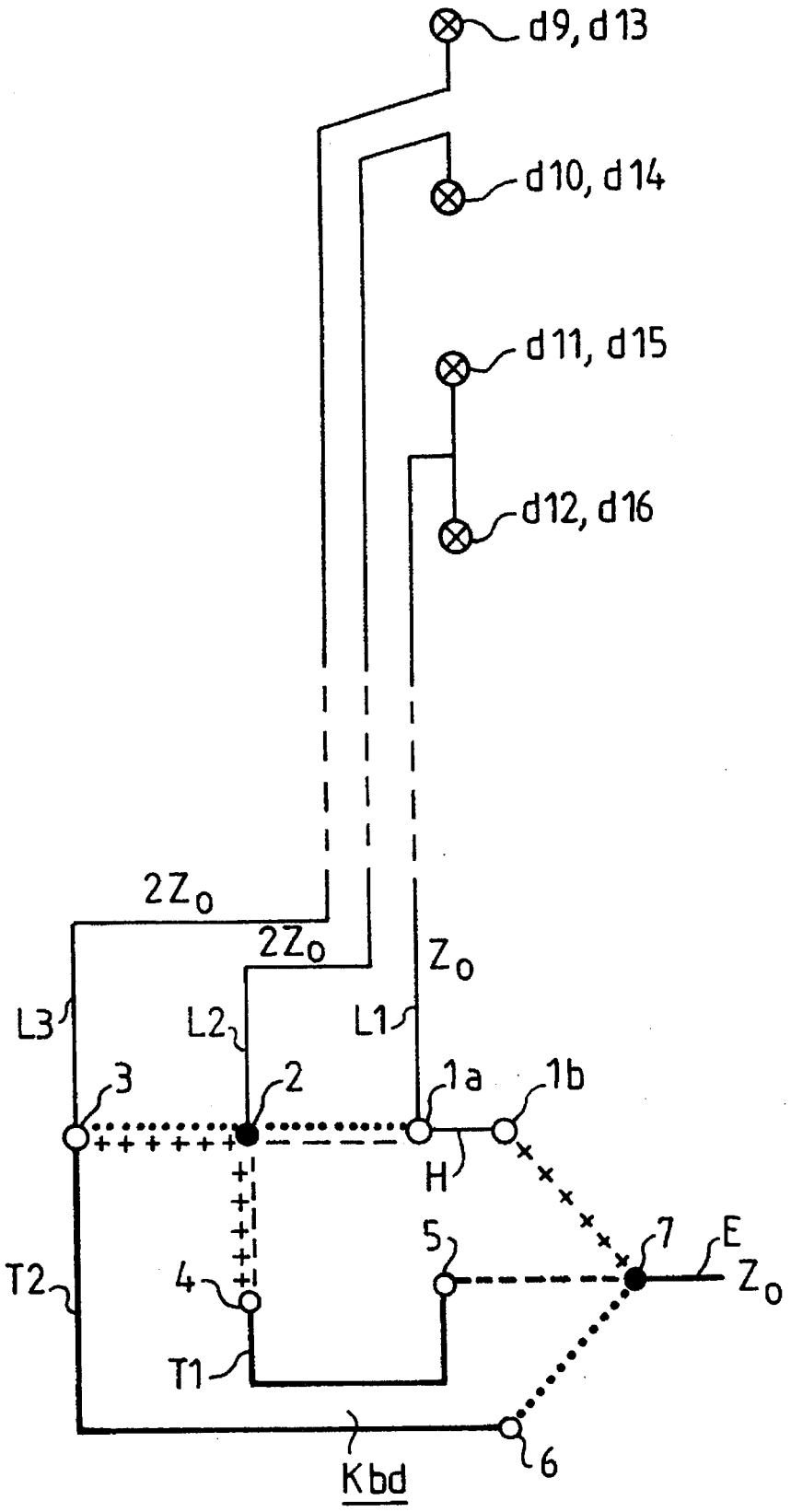
Figure 10:
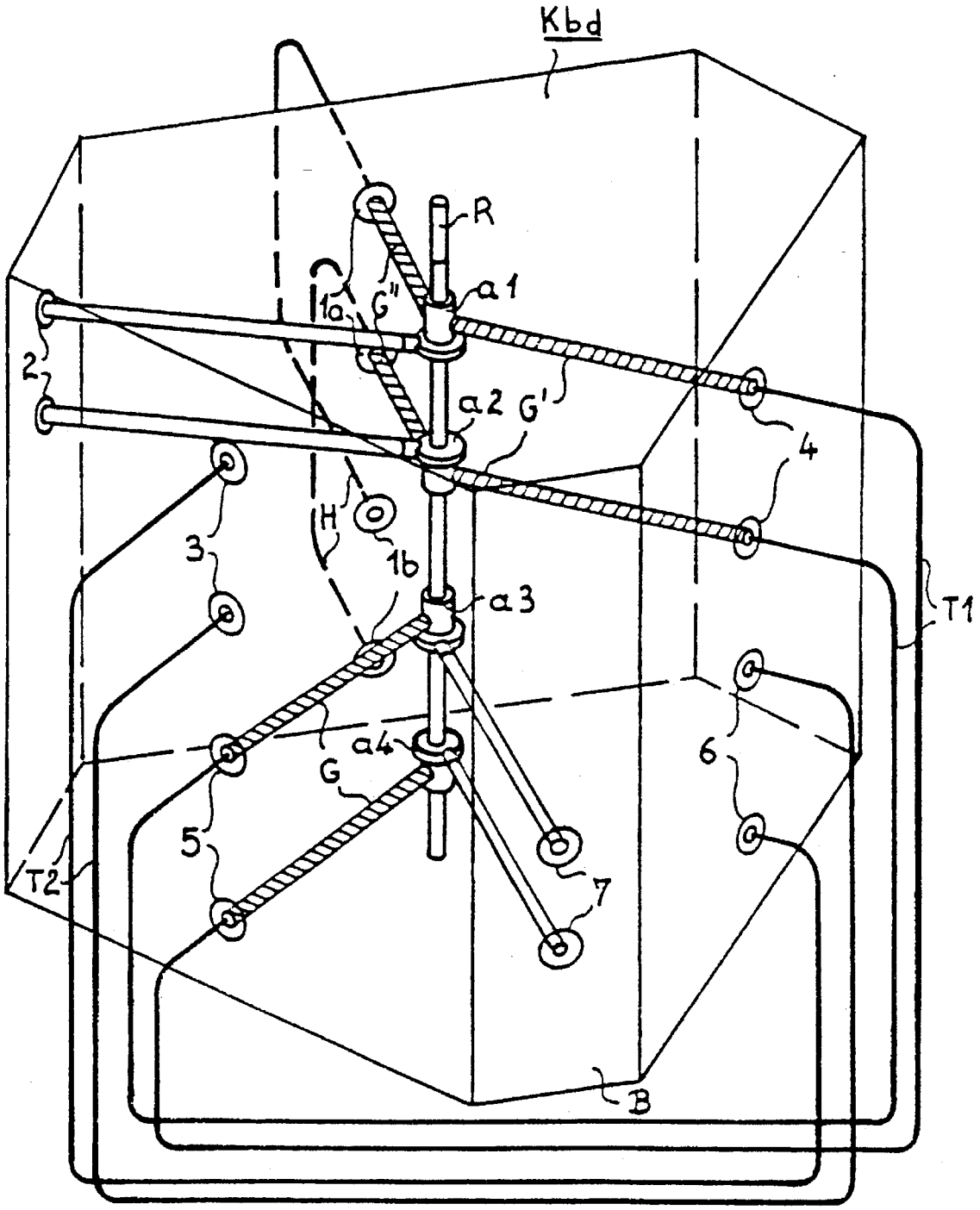

FIG. 9 shows that the dipoles d9–d13, d10–d14, d11–d15, d12–d16 form three groups supplied respectively by three distinct lines L1, L2, L3. The line L1, having a characteristic impedance of Zo, supplies a first group formed by two dipoles d11–d16 and d12–d16; the line L2, having a characteristic impedance 2Zo, supplies the second group formed by the dipole d10–d14 and the line L3, also having a characteristic impedance 2Zo, supplies the third group formed by the dipoles d9–d13. The lines L1, L2, L3 respectively reach the distribution ports formed by the terminals 1*a*, 2 and 3 of the switch Kbd which has eight terminals 1*a*, 1*b*, 2–7 and fixed or moving links between certain of these terminals. These links are designed to enable the supply either of the line L1 alone or of the lines L1 and L2 or of the lines L1, L2 and L3 from a feeder line E having a characteristic impedance Zo reaching the common port formed by the terminal 7. This line E is the line coming from the symmetrizer Sd of FIGS. 4 and 8.

The terminal 7 is coupled to a mobile arm which, in pivoting, is capable of taking three positions, shown respectively by a sequence of crosses, a sequence of dashes and a sequence of dots. Similarly, the terminal 2 is coupled to two mobile arms which, in pivoting, can each take three positions also shown respectively by sequences of crosses, dashes and dots.

The three mobile arms are mechanically linked in such a way that they can simultaneously take only the three positions identified by crosses, or only those identified by dashes or only those identified by dots.

The terminals 1*a* and 1*b* are connected by a very short line H with a uniform characteristic impedance Zo.

In the first position, identified by crosses, the terminal 7 is connected to the terminal 1*b* and the terminal 1*a* is not connected to the terminal 2 so much so that only the line L1 and therefore the two dipoles d11–d15 and d12–d16 are supplied.

In the second position, identified by dashes, the terminal 7 is connected to the terminal 5 and the terminal 2 to the terminals 1*a* and 4. Since, between the terminals 4 and 5, an impedance transformer T1 sets up a fixed link, the lines L1 and L2 and therefore the dipoles d10–d14, d11–d15, d12–d16 are supplied while the dipole d9–d13 is not supplied. The impedance transformer T1 is a wideband transformer designed to provide for the impedance matching between the line E having the characteristic impedance Zo and the lines L1, L2 having respective characteristic impedance values of Zo and 2Zo. Since the lines L1 and L2 are supplied in parallel, they correspond to a single line having a characteristic impedance of $$\frac{Zo \times 2Zo}{Zo + 2Zo} = \frac{2Zo}{3}$$

the transformer T1 is therefore designed to transform $$\frac{2Zo}{3}$$

into Zo.

In the third position, identified by dots, the terminal 7 is connected to the terminal 6 and the terminal 2 to the terminals 1*a* and 3. Since, between the terminals 3 and 6, an impedance transformer Tr2 sets up a fixed link, the three lines L1, L2, L3 and therefore the four dipoles are supplied. The transformer T2 too is a wideband impedance transformer designed for the impedance matching between the line E having the characteristic impedance of Zo and the lines L1, L2, L3 having respective characteristic impedance values of Zo, 2Zo and 2Zo. Since the lines L1, L2, L3 are supplied in parallel, they correspond to a single line with a characteristic impedance having a value of $$\frac{Zo \times 2Zo \times 2Zo}{Zo \times 2Zo + Zo \times 2Zo + 2Zo \times 2Zo} = \frac{Zo}{2}.$$

The transformer T2 is therefore designed to provide for the transformation of $$\frac{Zo}{2}$$

into Zo.

FIG. 10 shows a view in perspective of the way in which the switch Kbd of FIGS. 4 and 9 has been made. The switch Kbd comprises a metal box B, shown as if it were transparent. This box has the shape of a right prism whose section is constituted by a large, equilateral triangle that is truncated, at each of its three vertices, by one and the same small equilateral triangle. The different terminals 1*a*, 1*b*, 2–7 of the switch Kbd are carried by the wall of the box.

Inside the box, the switch Kbd has three double mobile arms G', G", G that are mounted on a common insulating shaft R positioned on the straight line, not shown, that passes through the central point of the cross-sections of the prism. The double arms G' and G" rotate in two same planes that are parallel to the bases of the prism; they are at 120° with respect to each other and are fixedly joined to the shaft R by means of hubs a1, a2, each having a disk located outside the planes in which the arms G' and G" rotate; a double fixed slide contact that rubs against the disks al and a2 and enables the terminal 2 to be connected to the arms G' and G"; the arms G', G" can make a complete rotation about the shaft R.

The double arm G is fixedly joined to two hubs a3, a4 each comprising a disk; a double, fixed slide contact rubs, at one of its ends, on the disks of the hubs and, at its other end, it is connected to the terminal 7. The arm G too can thus make a complete rotation about the axis R.

In FIG. 10, the arms G', G", G are shown in the position where they respectively connect the terminals 4 and 2, 1*a* and 2, 5 and 7. By the rotation of the shaft R, the arms G', G" and G may be brought into two other positions: one position in which they 5 respectively connect the terminals 3 and 2, 1*a* and 2, 6 and 7 and one position where they respectively connect the terminals 3 and 2, 4 and 2, 1*b* and 7.

The transformers T1 and T2 and the line H associated with the switch Kbd of FIG. 10 are respectively connected between the terminals 4 and 5, 3 and 6, 1*a* and 1*b*.

The rotary antenna that has just been described can therefore be used for transmission in several configurations of half-curtains and for the choosing, from among the four right-hand or left-hand half-curtains, of that curtain which will be connected to the transmitter E1 shown in FIG. 4 and that curtain which will be connected to the transmitter E2. It is clear that a transmitter can be connected to a right-hand half-curtain as well as to a left-hand half-curtain, the link being a function of the position of the mobile part of the rotary antenna with respect to the fixed part and that, for a given position of the rotary antenna, the transmitter E1 for example could be connected either to the high-frequency left-hand half-curtain or to the low-frequency right-hand half-curtain.

In view of these possibilities given by the rotary antenna that has just been described, four types of transmissions can be made:

two transmissions directed in azimuthal directions at 180° with respect to each other, the transmitter E1 transmitting on a frequency F1 and being connected, for example, to the high-frequency left-hand half-curtain, the transmitter E2 being then connected to the low frequency or high frequency left-hand half-curtain and transmitting on a frequency F2 with a sufficient difference between F1 and F2 to prevent disturbances for example $|F1-F2| \geqq 0.1(F1+F2)$.

two transmissions directed in one and the same azimuthal direction, the transmitter E1 transmitting on a frequency F1 and being connected, for example, to the low-frequency left-hand half-curtain, the transmitter E2 being then connected to the low-frequency right-hand half-curtain and transmitting on a frequency F2 with, here again, a difference in frequency that is sufficient to prevent disturbances, for example $|F1-F2| \geqq 0.1(F1+F2)$.

two transmissions directed in azimuthal directions at 180° with respect to each other, the two transmitters E1, E2 transmitting on one and the same frequency. In this case, a high degree of decoupling between the two curtains of dipoles must be ensured. This means that the two reflectors Rb, Rh should have sufficient height and width in relation respectively to the low-frequency and high-frequency dipole curtains and should have a spacing between the horizontal wires constituting them that is small enough with respect to the wavelengths of the low-frequency and high-frequency wavelengths respectively.

one and the same transmission on a complete curtain of the rotary antenna, namely throughout the high-frequency curtain or throughout the low-frequency curtain, the transmitter E1 supplying, for example, the low-frequency left-hand half-curtain and the transmitter E2 supplying the low-frequency right-hand half-curtain. For this type of transmission, the output power values of the two transmitters must be adjusted to the same value and the output signals of these transmitters should be in phase. This identity of phase is obtained by means of the phase comparator N according to FIG. 4, which in a standard way, adjusts the respective phases of the transmitters E1, E2 so as to nullify the phase difference between the signals that it measures with these two probes.

The present invention is not limited to the example described. It may be applied, in particular, to a rotary antenna having only one curtain of dipoles in order to enable two types of transmission:

two transmissions directed in one and the same azimuthal direction, one transmission on the complete curtain.

Similarly, the switches of dipoles may be eliminated. Thus, in the embodiment described, the switches Khg, Kbg, Khd, Kbd may be eliminated.

It is also possible to obtain the simultaneous transmission of the entire high-frequency curtain in one direction and the entire low-frequency curtain in the opposite direction, for example by the connection, to each of the two outputs of the joint J, of not just one symmetrizer-switch set as in FIG. 4 but of two sets, one for each vertical half of the antenna.

What is claimed is:

1. A broadcasting set formed by transmission means and a rotary antenna, the transmission means comprising two transmitters and supply means for the antenna, the antenna comprising a support with a fixed base, a vertical mast, a bi-coaxial rotating joint positioned between the base and the mast, pairs of horizontal girders positioned in one and the same vertical plane and fixed to the mast at different levels, the lowest pair constituting a platform on either side of the mast, m, with m as a positive integer smaller than 83, vertical reflector curtains and n, with n as an integer and $m \leqq n < 3$, parallel vertical curtains of wire dipoles each associated with one of the reflect or curtains, the supply means having two distinct channels whose paths respectively leave the two transmitters, go into the joint, rise within the mast up to the platform where they separate to respectively follow the two beams of the platform to which the channels are respectively fixed, then rise up vertically to the dipoles to respectively supply the dipoles of two distinct vertical portions of the n curtains of dipoles, the distinct channels each comprising a symmetrizer in the part of the path where they follow the platform, whereby two simultaneous transmissions are enabled from said rotary antenna.

2. A broadcasting set according to claim 1, wherein n is equal to 2, the channels include a band-changing switch in order to enable the choice, for each channel, of whether the distinct vertical portion will belong to one or the other of the two curtains of dipoles.

3. A broadcasting set according to claim 1, wherein the channels comprise connection means, associated with impedance transformers, to enable the connection, in the distinct vertical portions at which the two channels end, of only a part of the dipoles.

4. A broadcasting set according to claim 1, comprising a servo-control circuit to measure the phase difference between the output signals of the two transmitters and to control the two transmitters so that this phase difference gets cancelled.

* * * * *